US006082768A

United States Patent [19]

Johnson

[11] Patent Number: 6,082,768

[45] Date of Patent: Jul. 4, 2000

[54] ROLLER SKI

[75] Inventor: Lennart B. Johnson, Milford, N.H.

[73] Assignee: Jenex, Inc., Amherst, N.H.

[21] Appl. No.: 08/843,091

[22] Filed: Apr. 25, 1997

[51] Int. Cl.[7] ..... A63C 17/14; A63C 17/06

[52] U.S. Cl. ..... 280/842; 280/11.21; 280/11.23; 280/11.3

[58] Field of Search ..... 280/842, 11.2, 280/11.22, 11.21, 11.3, 11.14, 615, 633, 623; 188/25; 36/117.8, 117.9, 115

[56] References Cited

U.S. PATENT DOCUMENTS

| | | | |
|---|---|---|---|
| 606,496 | 6/1898 | Allen | 188/25 |
| 650,228 | 5/1900 | Cattaneo | 188/25 |
| 893,341 | 7/1908 | Martinsen | 280/11.14 |
| 926,646 | 6/1909 | Eubank, Jr. | 280/11.2 |
| 1,312,739 | 8/1919 | Leblanc | 280/11.3 |
| 1,497,224 | 6/1924 | Ormiston | 280/11.2 |
| 1,501,589 | 7/1924 | Ferris | 188/25 |
| 3,156,324 | 11/1964 | Colbert | 188/80 |
| 3,790,187 | 2/1974 | Radu et al. | 280/11.2 |
| 4,033,596 | 7/1977 | Andorsen et al. | 280/842 |
| 4,061,348 | 12/1977 | Carter | 280/11.21 |
| 4,072,317 | 2/1978 | Pommerening | 280/11.3 |
| 4,147,378 | 4/1979 | Reich | 280/633 |
| 4,275,895 | 6/1981 | Edwards | 280/11.2 |
| 4,312,514 | 1/1982 | Horowitz et al. | 280/11.2 |
| 4,497,393 | 2/1985 | Brems | 188/322.5 |
| 4,526,389 | 7/1985 | Chase | 280/11.21 |
| 4,759,428 | 7/1988 | Seshimo | 188/312 |
| 4,768,793 | 9/1988 | Spencer | 280/842 |
| 4,805,936 | 2/1989 | Krantz | 280/842 |
| 4,844,491 | 7/1989 | Wheelwright | 280/11.2 |
| 4,898,403 | 2/1990 | Johnson | 280/842 |
| 4,943,072 | 7/1990 | Henig | 280/11.2 |
| 4,987,978 | 1/1991 | Jungersen | 188/2 F |
| 5,183,275 | 2/1993 | Hoskin | 280/11.2 |
| 5,374,071 | 12/1994 | Johnson | 280/11.2 |
| 5,375,070 | 12/1994 | Pelligrini, Jr. et al. | 280/11.2 |
| 5,411,276 | 5/1995 | Moldenhauer | 280/11.2 |
| 5,487,552 | 1/1996 | Daoust | 280/11.22 |
| 5,511,805 | 4/1996 | McGrath | 280/11.2 |
| 5,645,288 | 7/1997 | Lu | 280/11.22 |
| 5,704,617 | 1/1998 | Stoughton | 280/11.2 |

FOREIGN PATENT DOCUMENTS

| | | | |
|---|---|---|---|
| 1104413 | 11/1955 | France | 280/11.2 |
| 2527611 | 12/1976 | Germany | 280/842 |
| 2726961 | 1/1979 | Germany | 280/11.2 |
| 2913456 | 10/1980 | Germany | 280/842 |
| 22575 | 4/1897 | United Kingdom . | |
| 1422151 | 1/1976 | United Kingdom . | |

*Primary Examiner*—J. J. Swann
*Assistant Examiner*—Frank Vanaman
*Attorney, Agent, or Firm*—Fish & Richardson P.C.

[57] ABSTRACT

In one aspect, a roller ski is provided that includes a foot-supporting enclosure that enables the ski to be used without ski boots or ski bindings. In another aspect, a roller ski is provided that includes a cuff-actuated brake.

25 Claims, 7 Drawing Sheets

ROLLER SKI

BACKGROUND OF THE INVENTION

The present invention relates to roller skis.

Roller skis are used by skiers, typically competitive cross-country and Alpine skiers, for sport-specific training, i.e., to simulate cross-country skiing technique by rolling the roller skis along a non-snow surface, typically a roadway, track or sidewalk.

Roller skis generally have two wheels, mounted at opposite ends of an elongated, ski-like member, and a cross-country binding that is mounted on the ski-like member to receive a cross-country boot and thus secure the foot of the user to the ski.

Because roller skis tend to be unstable, requiring the user to have very good balance, use of roller skis by non-skiers and recreational skiers has generally been limited. Use by non-skiers has been further limited by their reluctance to purchase cross-country boots and bindings to use with the roller skis.

SUMMARY OF THE INVENTION

The present invention features a roller ski that allows users to enjoy the exercise benefits of cross country skiing without snow, without having to master the skills of elite skiers, and without having to buy expensive ski boots and bindings. In addition, the roller ski includes braking features which enhance the safety and ease of use of the roller ski.

In one aspect, the invention features a roller ski that includes an elongated member having a front portion and a rear portion, a first rear wheel mounted at the rear portion of the elongated member and a front wheel mounted at the front portion, and an adjustable foot supporting enclosure, mounted on the elongated member between the first rear wheel and the front wheel. Advantageously, the adjustable foot supporting enclosure is constructed to eliminate the need for a ski binding or a ski boot.

In another aspect, the invention features a roller ski that includes a brake that is constructed to be actuated by movement of a user's leg, and, when so actuated, to apply a braking force to a contact surface associated with the rear wheel, for example, a surface of the rear wheel, or a hub on which the rear wheel is mounted. Preferably, the brake is actuated by a user when the user extends his lower leg (his calf) a predetermined distance toward the rear wheel of the ski. This "cuff-actuated" brake is very effective and easy to actuate, and the natural body position required to actuate the brake provides a stable position in which the user is less likely to be pitched forward during braking.

Preferred embodiments of this aspect of the invention include the following features. The roller ski includes a flexible cuff constructed to be worn around the user's lower leg, and, extending outwardly from a rear surface of the flexible cuff, a mechanical linkage which can actuate a frictional braking system that is constructed to apply braking pressure to the rear wheel. The frictional braking system includes a brake pad mounted on a pivotable brake arm so that when pressure is applied by a user's calf to the flexible cuff, the pressure is transmitted via pivoting movement of the brake arm to the brake pad so that pressure is applied to the outer surface of the rear wheel. The brake pad comprises a material having a hardness greater than Rockwell C50. The brake pad comprises a high friction material. The brake arm is constructed to provide a mechanical advantage when braking force is applied thereto.

Preferred embodiments of both of the above aspects of the invention include one or more of the following features. The roller ski includes a foot platform, mounted on the elongated member in a manner to allow rotation of at least a portion of the foot platform relative to the elongated member, the adjustable foot supporting enclosure extending upwardly from a portion of the foot platform. The roller ski includes two rear wheels mounted substantially coaxially, to provide lateral stability to the elongate member. The front wheel has a one-way clutch mechanism which enables the wheel to roll only in the forward direction. Mounted to the front wheel is a lever-actuated speed reduction device, i.e., a roller device that can be pressed against the front wheel, by actuating a lever, so that the roller increases the rolling resistance of the wheel. Suitable speed reduction devices are described in U.S. Pat. No. 5,374,071, the disclosure of which is incorporated herein by reference. In some preferred embodiments, the roller device is constructed with kinematic damping, e.g., as described in U.S. Pat. No. 4,898,403, the disclosure of which is incorporated herein by reference. This kinematic damping will provide additional rolling resistance without additional displacement of the elastomeric wheel material, resulting in lower rolling speeds without additional heat buildup in the elastomeric wheel (the major cause of wheel failure). With the speed reduction device engaged, speed on downhills can be kept sufficiently low so that the cuff-actuated braking system can be safely engaged and will provide improved braking.

Other features and advantages of the invention will be apparent from the description of preferred embodiments thereof, taken together with the drawings, and from the claims.

DESCRIPTION OF THE PREFERRED EMBODIMENTS

Figure 1:
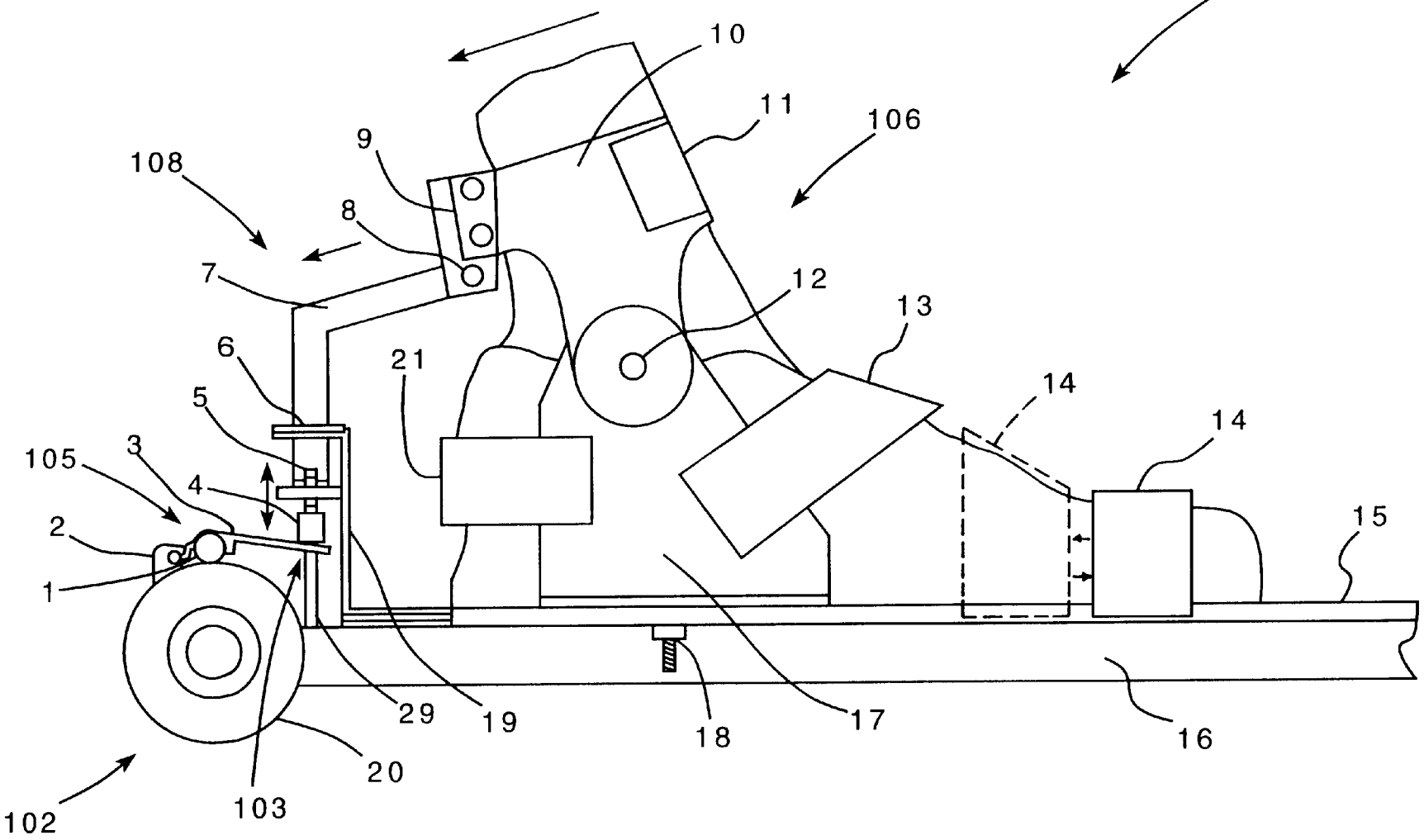
FIG. 1 is a side view of a roller ski according to one embodiment of the invention, with the user's foot in a braking position.
Figure 2:
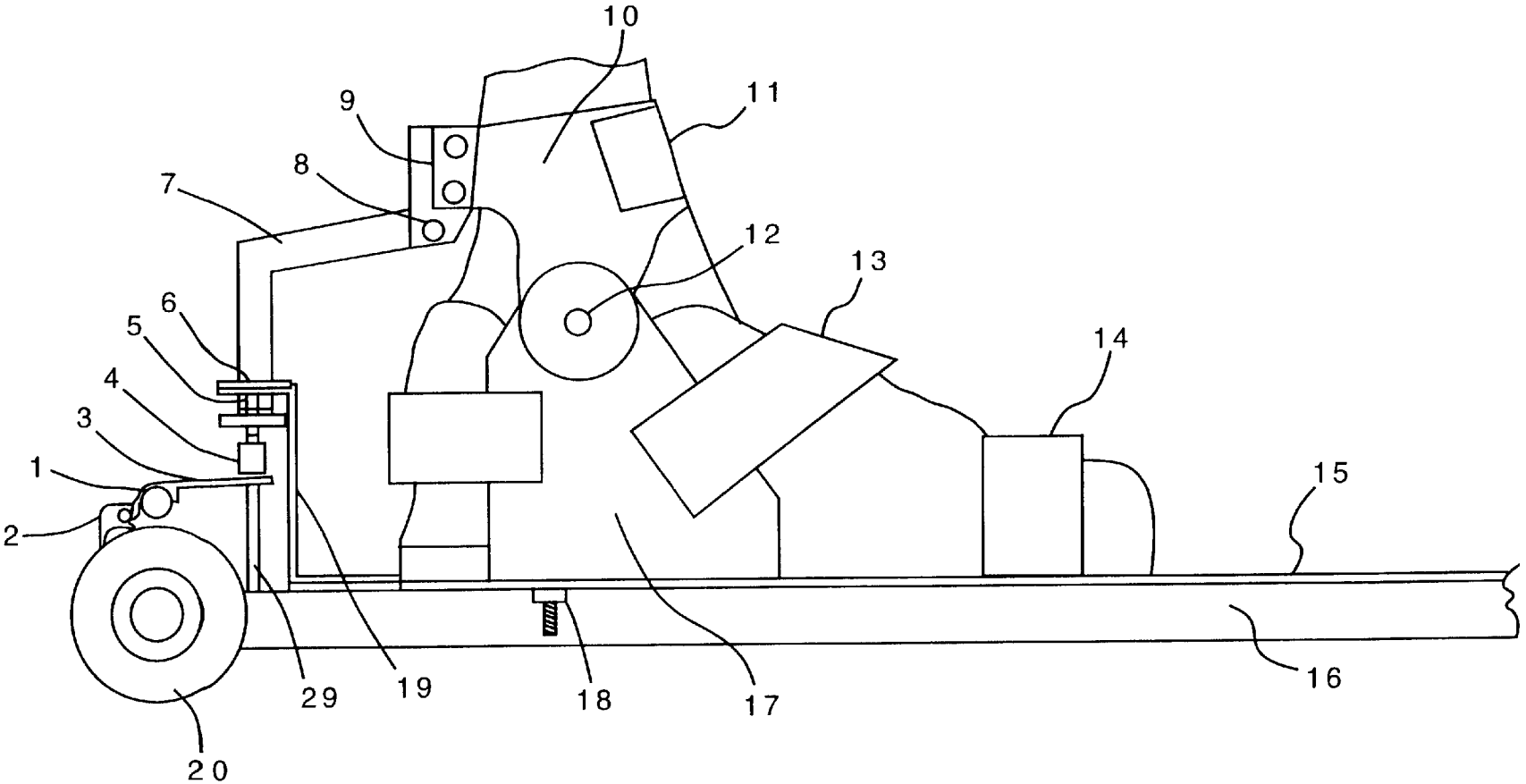
FIG. 2 is a side view of the roller ski of FIG. 1, with the user's foot and lower leg in a gliding, non-braking position.
Figure 3:
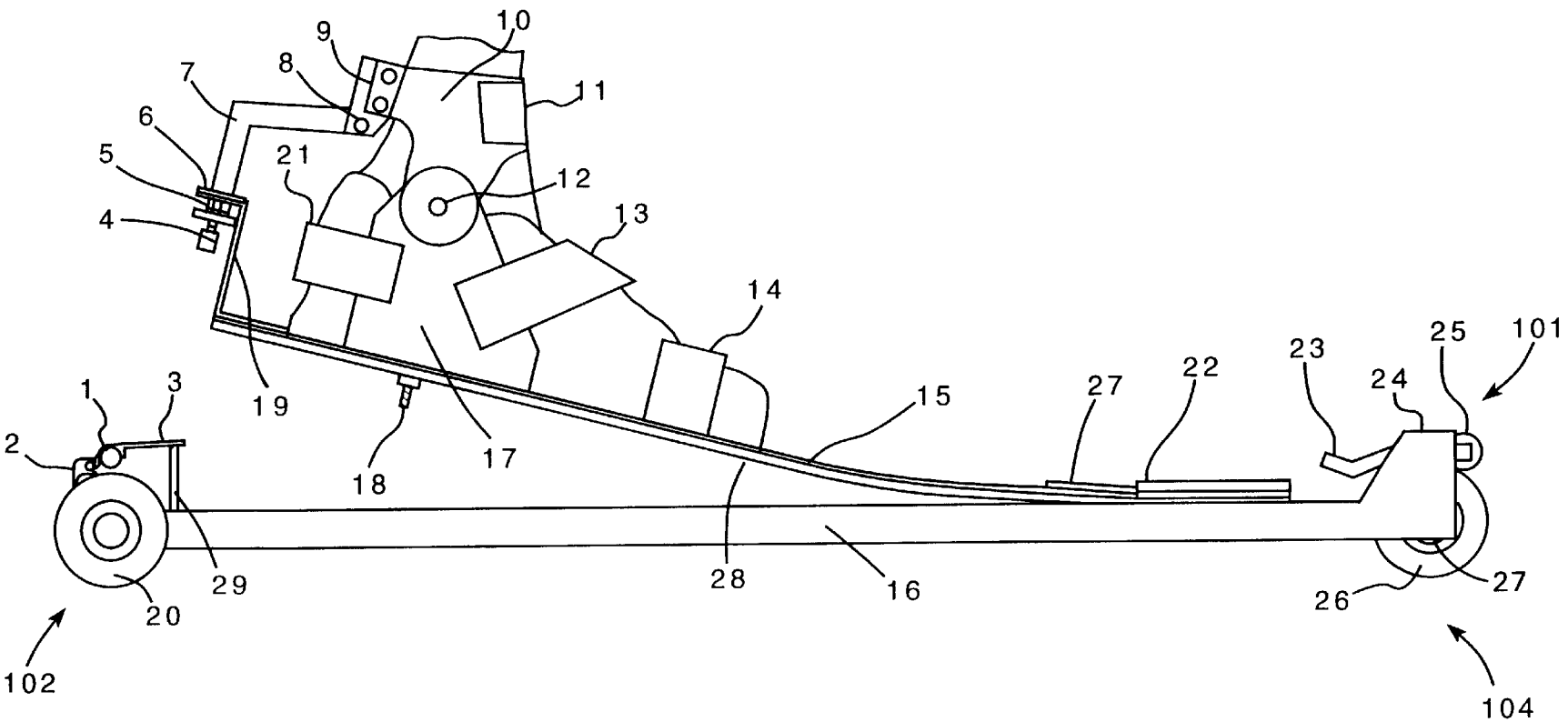
FIG. 3 is a side view of the roller ski of FIG. 1, with the user's foot and lower leg in a striding position.
Figure 4:
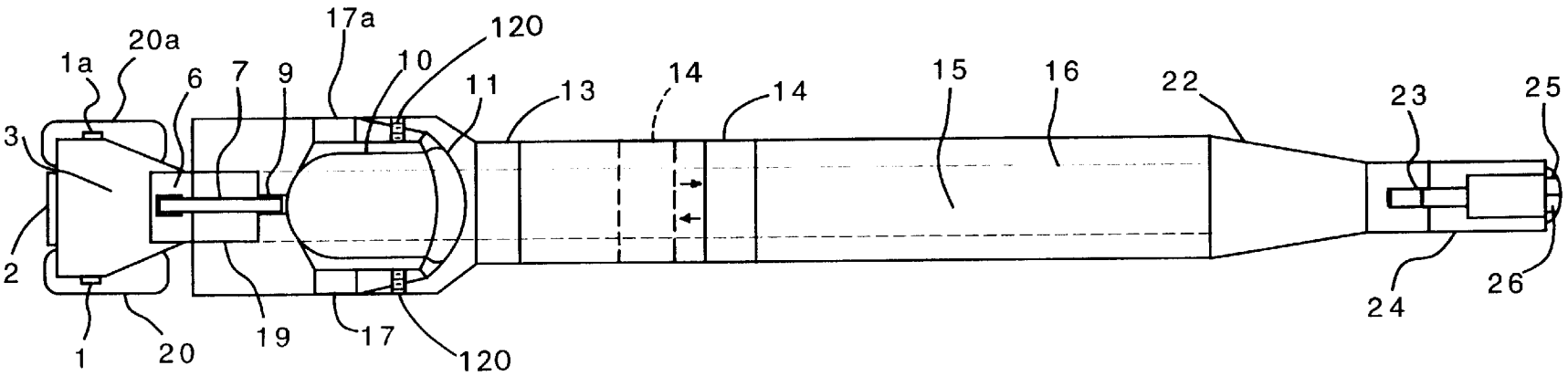
FIG. 4 is a top view of the roller ski of FIG. 1.

Referring to FIGS. 1–4, roller ski 100 includes a support member 16, onto which are mounted, at rear portion 102, two rear wheels 20, 20*a* (FIG. 4), and, at front portion 104, a single front wheel 26 (FIG. 3). Front wheel 26 is mounted in a front wheel housing 24, which includes a speed reducing device 101 (FIG. 3) that includes a roller 25 that is actuated (pressed against wheel 26) by movement of a lever 23, as described in U.S. Pat. No. 5,374,071, incorporated by reference above.

Roller ski 100 further includes a flexible foot platform 15, onto which a foot supporting enclosure 106 is mounted. In normal cross country skiing the heel must be free to move upward (as in walking or jogging). This is accomplished by having the foot supporting enclosure 106 mounted on the flexible foot platform 15. Flexible foot platform 15 is laterally stiff, thus providing good support, while still being able to flex, as shown in FIG. 3, to allow the user's heel to move freely upward into the striding position. Preferred flexible foot platforms can withstand over 500,000 cycles between the positions shown in FIGS. 2 and 3 without fatigue failure. Preferably, the flexible foot platform 15 is formed of a flexible, fatigue resistant plastic, e.g., high density polyethylene or polypropylene. The flexible foot platform may be mounted in any suitable manner. For example, the flexible foot platform may be interposed between two metal plates (structural support plates 22, FIGS. 3 and 4), and this sandwich assembly screwed to support member 16. Preferably, a sheet of cushioning material 27, 28 is interposed between each structural support plate and the flexible foot platform to cushion and reinforce the assembly during flexure. Suitable cushioning materials include the hook portion of hook and loop fastener material (e.g., material commercially available under the tradename "VELCRO" fabric), and elastomeric sheet material such as rubbers and filled rubbers.

Foot supporting enclosure 106 includes side supports 17, flexible cuff 10, and straps 11, 13, 14 and 21. Mounted to the flexible cuff 10 is a pivot pin 12, which allows the flexible cuff to pivot with respect to the side supports 17.

The foot supporting enclosure 106 is designed to accommodate shoes, preferably running, tennis or cross training shoes. The side structures 17 are adjustable in width by loosening adjustment screw 18 and sliding the side structures apart, e.g., along a track 120 formed in the base of the side structures (dashed lines in FIG. 4). Straps 11, 13, 14, and 21 are also adjustable (e.g., are made of a hook and loop fastener such as that sold under the tradename "VELCRO") to accommodate different size shoes. The length of the foot supporting enclosure is also adjustable by sliding strap 14 backward or forward relative to the flexible foot platform 15, as shown by the arrows and by the phantom image of strap 14 in FIGS. 1 and 4. The side supports 17 and cuff 10 are sufficiently rigid to provide good lateral support, while allowing the foot to naturally pivot about pin 12. Suitable materials for the side supports and cuff include semi-rigid thermoplastics, for example, Nylon modified to have a desired degree of flexibility. The inside surfaces of the cuff 10 and side supports 17 are padded for comfort.

The user's foot is secured into the foot supporting enclosure 106 by (a) pushing the user's shoe against strap 21 and, if necessary, adjusting the position of strap 21 so that the calf of the leg is pushed securely against the back of the cuff 10; and (b) securing strap 13, followed by straps 11 and 14.

Roller ski 100 also includes a cuff-actuated brake assembly 108. Brake assembly 108 includes a brake arm support 9 that is rigidly mounted on the rearwardly facing outer surface of flexible cuff 10. Rotatably mounted on brake arm support 9, via pin 8, is brake arm 7. Brake arm 7 is in turn joined to an adjustable post 5, onto which is mounted an elastomeric pressure pad 4. Adjustable post 5 is threaded to allow the pressure pad to be moved upward or downward to compensate for wear of brake pads 1, la and/or wear of wheels 20, 20*a*, and also to compensate for different skier stances (more or less forward lean). Facing, but normally spaced from elastomeric pressure pad 4, is pivot arm 3. Pivot arm 3 is rotatably mounted on pivot arm support 2, which is itself rigidly mounted on support member 16. Pivot arm 3 is rotatably mounted so that, upon pressure exerted by elastomeric pressure pad 4 (when pressure pad 4 is deflected downward) on free end 103 of pivot arm 3, pivot arm 3 will pivot downward. Mounted at the opposite end 105 of the pivot arm 3 are brake pads 1, 1*a* (see FIG. 4) which, when pivot arm 3 pivots downward, will be forced against the perimeter of wheels 20, 20*a*. Brake assembly 108 further includes a return spring 29, positioned to cause pivot arm 3 to return to its normal position, spaced from elastomeric pressure pad 4, when pressure is released. Finally, brake assembly 108 includes a brake guide 19 that is mounted, at one of its ends, on foot platform 15, between the foot supporting enclosure 106 and the rear portion 102, and, at its other end, to a guide plate 6 having an aperture (not shown) through which brake arm 7 slides up and down. Guide plate 6 is preferably formed of a rigid plastic having a low coefficient of friction, e.g., DELRIN plastic. Brake guide 19 and guide plate 6 together align elastomeric pressure pad 4 with pivot arm 3 to assure that contact is made each time the user moves his calf a sufficient distance backward to apply a braking force.

The operation of brake assembly 108 will now be explained, with reference to FIGS. 1–3.

To help propel the roller skis the user has ski poles with special tips that are designed for use on non-snow surfaces. As one leg is moved forward, as in walking or jogging, the heel is lifted naturally as shown in FIG. 3 and the ski is prevented from rolling backward by the unidirectional rotary clutch in front wheel 26. Alternating with left and right leg motion, moving each leg between the two positions shown in FIGS. 2 and 3, while pushing with the poles, the roller skier is able to achieve substantially the same motion as a cross country snow skier.

To add rolling resistance, the user can move lever 23 upward into one of several lockable positions. The lever forces the roller 25 into contact with the wheel 26, increasing rolling resistance. This is especially beneficial for a higher resistance exercise workout and also for controlling rolling speed on downhills, as discussed above.

Figure 5:
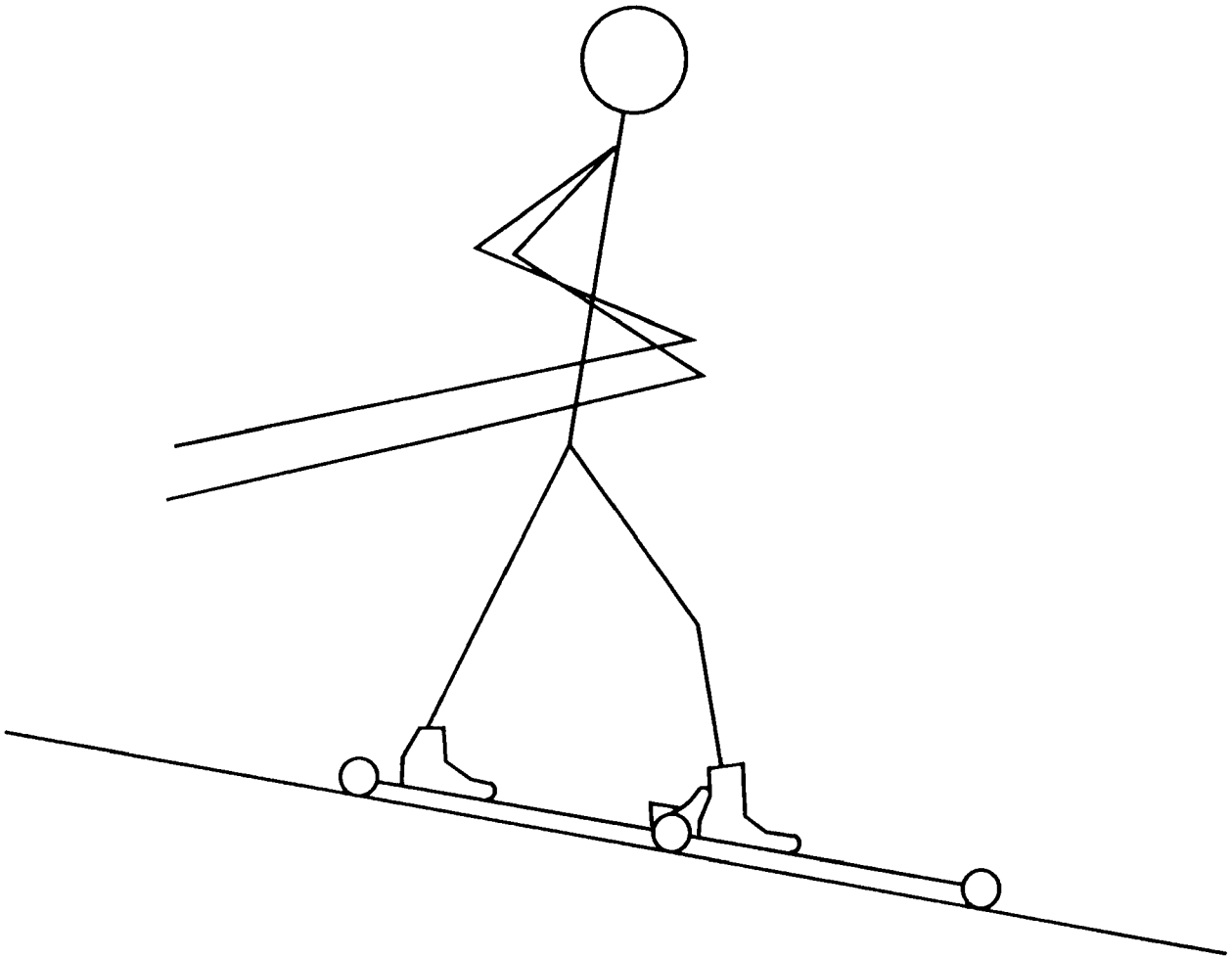
FIG. 5 is a schematic side view showing the body position of a user of the roller ski of FIG. 1 during braking.

When the user wishes to slow down, the user's right or left leg is pushed slightly ahead of the other leg and the cuff 10 is pushed backward by the calf of the user's leading leg to actuate brake assembly 108, as shown in FIGS. 1 and 5. This rearward deflection of the user's calf causes the brake arm 7 to force the adjustable post 5 downward against pressure pad 4, which in turn presses against pivot arm 3, causing brake pads 1 to contact wheels 20. This contact between brake pads 1 and wheels 20 results in a smooth and uniform braking motion due to the friction between the stationary pads and the rotating wheels. Depending on the amount of force applied by the user, the user will either slow down or stop.

Figure 6:
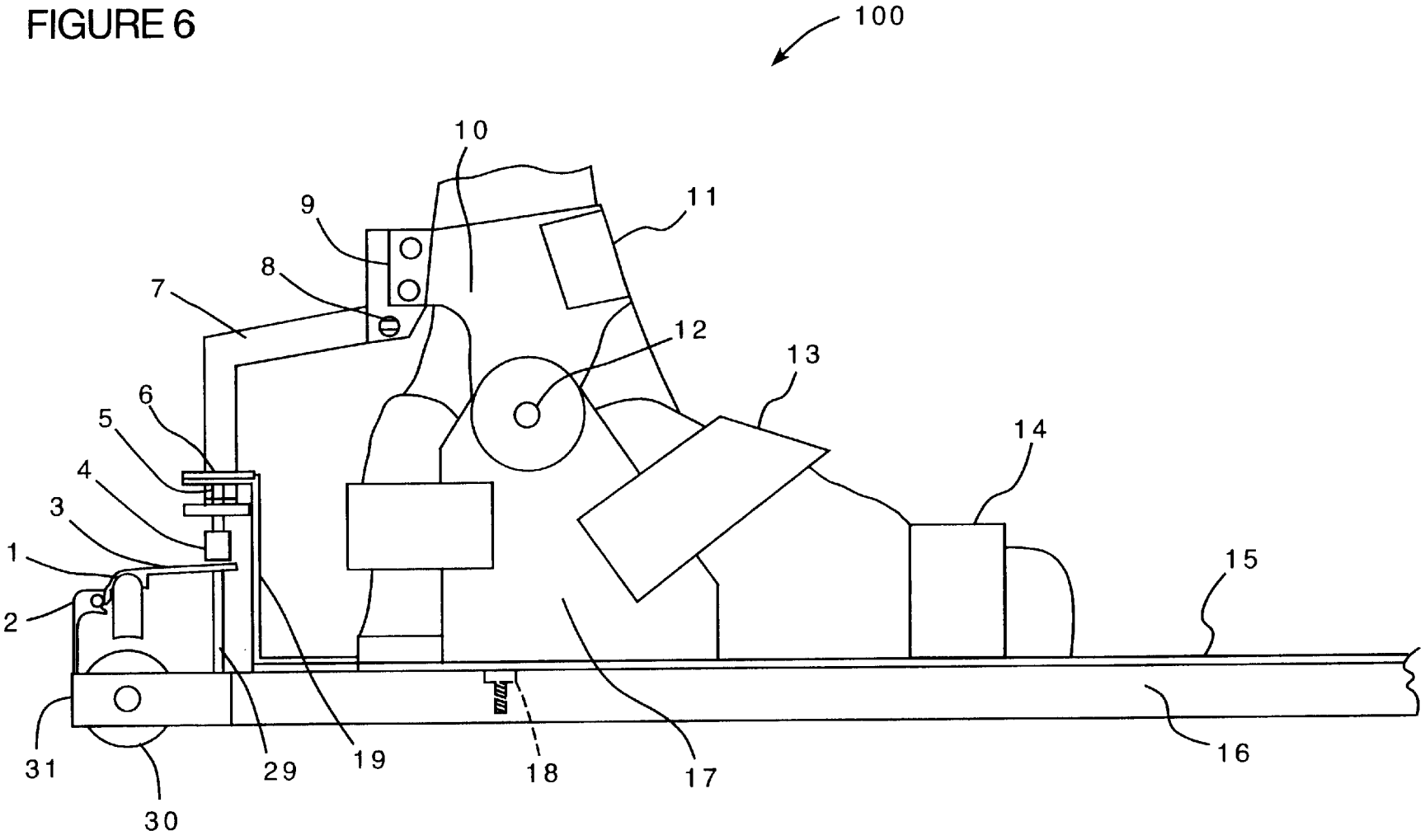
FIG. 6 is a side view of a roller ski according to an alternative embodiment of the invention.
Figure 8:
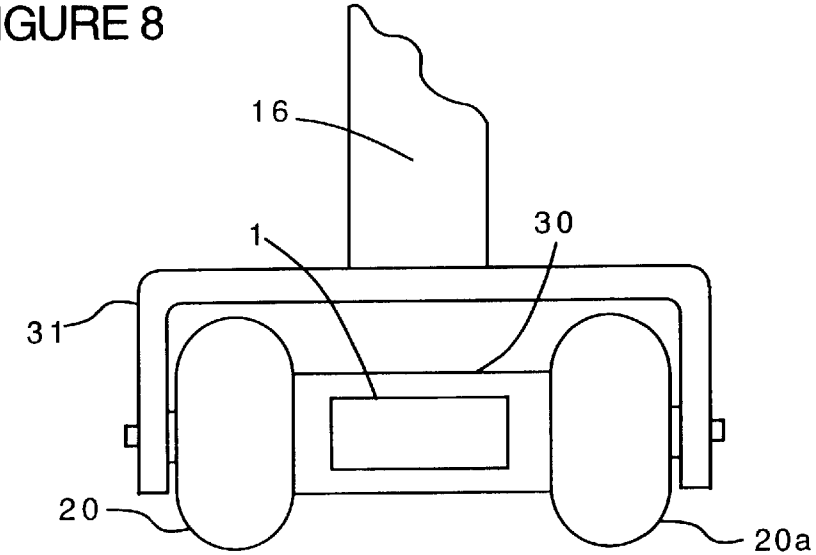
FIG. 8 is a top view of the roller ski of FIG. 6.
Figure 7:
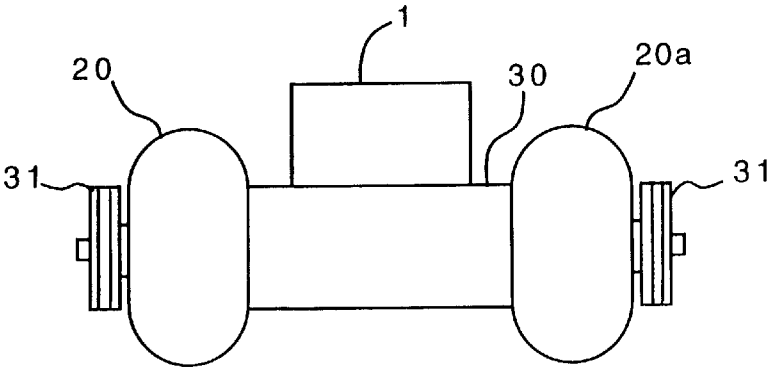
FIG. 7 is a rear view of the roller ski of FIG. 6.

A roller ski 100 according to an alternative embodiment of the invention is shown in FIGS. 6–8. (It is noted that in FIG. 6 the rear wheels of the roller ski are omitted for clarity, and in FIGS. 7 and 8 the elements of the braking assembly, other than brake pad 1, are omitted for clarity.) In this embodiment, the brake pad 1 contacts a metallic hub 30 that extends between wheels 20, 20*a*, rather than directly contacting wheels 20, 20*a* themselves. This metal-to-elastomer contact tends to result in more efficient braking than the elastomer-to-elastomer contact provided in the previously described embodiment. In this embodiment (and in other embodiments which would provide metal-to-elastomer contact), it is preferred that the brake pad 1 be constructed of a relatively soft, high friction material, e.g., elastomers which would be suitable for use in bicycle brake pads.

OTHER EMBODIMENTS

Other embodiments are within the scope of the following claims. For example, other materials and dimensions could be used.

Moreover, instead of providing a flexible foot platform 15, the foot platform may be rigid, so long as it is mounted on the support member 16 in a manner so that the foot platform can pivot about its attachment point. For example, the foot platform could be mounted to the support member 16 by a hinge or other pivotal mounting.

In addition, instead of mounting the brake pad 1 for contact with wheels 20, 20*a* (FIGS. 1–3), or with hub 30 (FIGS. 6–8), the brake pad can be mounted to contact any suitable structure mounted on or associated with wheels 20, 20*a*, e.g., metal portions mounted on side surfaces of wheels 20, 20*a*. Also, the brake pad 1 could be mounted directly to brake arm 7, in which case brake arm 7 would be constructed to directly force brake pad 1 against its contact surface (e.g., wheels 20, 20*a* or hub 30).

Further, instead of two coaxially mounted rear wheels 20, 20*a*, the roller ski could have a single rear wheel, a common feature of roller skis designed for advanced skiers, or could have two or more wheels mounted "in-line" (as the wheels of "in-line" skates are mounted).

What is claimed is:

1. A roller ski comprising:

an elongated member having a front portion and a rear portion, a first rear wheel mounted at said rear portion of said elongated member and a front wheel mounted at said front portion, a foot platform, mounted on said elongated member in a manner to allow rotation of at least a portion of said foot platform relative to said elongated member, said foot platform having a length substantially less than a length of said elongated member, and an adjustable foot supporting enclosure, mounted on said foot platform on said elongated member between said first rear wheel and said front wheel, said adjustable foot supporting enclosure comprising a cuff constructed to be worn about a user's lower leg, said cuff being operably attached to a portion of a brake assembly to transmit force applied by the user's lower leg to said brake assembly.

2. The roller ski of claim 1, wherein said adjustable foot supporting enclosure extends upwardly from a portion of said foot platform.

3. The roller ski of claim 1 wherein said foot platform is flexible.

4. The roller ski of claim 1 wherein said foot platform is rigid, and a forward end of said foot platform is pivotably mounted to said elongated member.

5. The roller ski of claim 4 wherein said foot platform is mounted by a hinge.

6. The roller ski of claim 1 wherein said foot supporting enclosure comprises a side portion and wherein said cuff is a flexible cuff that is pivotably mounted to said side portion.

7. The roller ski of claim 1 further comprising a second rear wheel, arranged substantially coaxially with respect to said first rear wheel.

8. The roller ski of claim 1, further comprising, extending outwardly from a rear surface of said cuff, a mechanical linkage which can actuate said brake assembly, said brake assembly being constructed to apply braking pressure to said rear wheel.

9. The roller ski of claim 8 wherein said brake assembly comprises a brake pad mounted on a pivotable brake arm so that when pressure is applied by a user's calf to the cuff, the pressure is transmitted via pivoting movement of the brake arm to the brake pad so that pressure is applied to the outer surface of the rear wheel.

10. The roller ski of claim 9, wherein the brake pad comprises a material having a hardness greater than Rockwell C50.

11. The roller ski of claim 9, wherein the brake arm is constructed to provide a mechanical advantage when braking force is applied thereto.

12. The roller ski of claim 1, further comprising a unidirectional rotary clutch associated with said front wheel in a manner to restrict reverse rotation of said front wheel.

13. The roller ski of claim 1 further comprising a roller that is positioned relative to the front wheel to be moveable between a first position in which the roller is spaced from the outer surface of the front wheel, and a second position in which the roller contacts the outer surface of the front wheel, causing an increase in rolling resistance.

14. The roller ski of claim 13 wherein said roller is moveable to a plurality of positions in which it contacts the outer surface of the front wheel with varying degrees of pressure.

15. The roller ski of claim 1, wherein the foot supporting enclosure is adjustable in width by moving a portion of the foot support enclosure relative to the foot platform.

16. The roller ski of claim 1, wherein the foot supporting enclosure is adjustable in length to accommodate shorter or longer shoes.

17. The roller ski of claim 1 further comprising a mechanism providing adjustable rolling resistance to a said wheel.

18. A roller ski comprising:

an elongated member having a front portion and a rear portion, a first rear wheel mounted at said rear portion of said elongated member and a front wheel mounted at said front portion, a foot platform, mounted on said elongated member in a manner to allow rotation of at least a portion of said foot platform relative to said elongated member, an adjustable foot support mounted on said foot platform and including a cuff constructed to be worn about a user's lower leg, said foot support having a length substantially smaller than a length of said elongated member, and a brake-assembly constructed to be actuated by movement of said cuff by a user's lower leg when said platform is in a lowered position on said elongated member, and to, when actuated, apply a braking pressure to a contact surface associated with said first rear wheel.

19. The roller ski of claim 18, further comprising, extending outwardly from a rear surface of said cuff, a mechanical linkage which can actuate said brake assembly.

20. The roller ski of claim 19 wherein said brake assembly comprises a brake pad mounted on a pivotable brake arm so that when pressure is applied by a user's calf to the cuff, the pressure is transmitted via pivoting movement of the brake arm to the brake pad so that pressure is applied to the outer surface of the rear wheel.

21. The roller ski of claim 20, wherein the brake pad comprises a material having a hardness greater than Rockwell C50.

22. The roller ski of claim 20, wherein the brake arm is constructed to provide a mechanical advantage when braking force is applied thereto.

23. The roller ski of claim 18, further comprising a unidirectional rotary clutch associated with said front wheel in a manner to restrict reverse rotation of said front wheel.

24. The roller ski of claim 18 further comprising a roller that is positioned relative to the front wheel to be moveable between a first position in which the roller is spaced from the outer surface of the front wheel, and a second position in which the roller contacts the outer surface of the front wheel, causing an increase in rolling resistance.

25. The roller ski of claim 18 further comprising a mechanism providing adjustable rolling resistance to a said wheel.

* * * * *